US009506323B2

(12) United States Patent
Meier et al.

(10) Patent No.: US 9,506,323 B2
(45) Date of Patent: Nov. 29, 2016

(54) DOWNHOLE SYSTEM HAVING CHEMICAL INJECTION VALVE ASSEMBLY AND METHOD OF CHEMICAL INJECTION

(71) Applicants: Kyle R. Meier, Katy, TX (US); Marc N. Samuelson, Houston, TX (US); David S. Bishop, Houston, TX (US); Zhi Yong He, Cypress, TX (US)

(72) Inventors: Kyle R. Meier, Katy, TX (US); Marc N. Samuelson, Houston, TX (US); David S. Bishop, Houston, TX (US); Zhi Yong He, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 422 days.

(21) Appl. No.: 14/089,000

(22) Filed: Nov. 25, 2013

(65) Prior Publication Data

US 2015/0144353 A1 May 28, 2015

(51) Int. Cl.
*E21B 34/10* (2006.01)
*E21B 37/06* (2006.01)

(52) U.S. Cl.
CPC ..... *E21B 37/06* (2013.01)

(58) Field of Classification Search
USPC ..... 166/374, 319
See application file for complete search history.

(56) References Cited

U.S. PATENT DOCUMENTS 4,399,871 A * 8/1983 Adkins ..... E21B 34/06 137/539.5
5,141,056 A 8/1992 Tailby
6,880,639 B2 4/2005 Rhodes et al.
8,016,035 B2 9/2011 Strattan et al.
2004/0040718 A1 3/2004 Rhodes et al.
2005/0098210 A1* 5/2005 Strattan ..... E21B 34/105 137/70
2007/0277878 A1 12/2007 Strattan et al.
2010/0101788 A1 4/2010 Mennem et al.
2011/0067876 A1 3/2011 Turner et al.
2012/0318367 A1 12/2012 Going et al.
2012/0325493 A1 12/2012 Rees et al.
2013/0180592 A1 7/2013 He et al.

OTHER PUBLICATIONS

Schlumberger, "TLC-4R-B Chemical Injection Valve" Barrier Series rupture-disc retrievable valve, www.slb.com/gaslift, Schlumberger 2012, pp. 1.
Weatherford, "Tubing-Retrievable Chemical-Injection Valve" Gas Lift, Waterford INternational Ltd, Houston, Texas, www.weatherford.com, 2005 Weatherford, pp. 1-2.
International Search Report and Written Opinion, International Application No. PCT/US2014/061545, Date of Mailing Jan. 21, 2015, Korean Intellectual Property Office, International Search Report 5 pages; Written Opinion 4 pages.

* cited by examiner

*Primary Examiner* — Taras P Bemko
(74) *Attorney, Agent, or Firm* — Cantor Colburn LLP

(57) ABSTRACT

A downhole system having a chemical injection valve assembly configured to inject at least one chemical from a chemical injection line into a downhole tubing. The chemical injection valve assembly includes a passive access control mechanism configured to reveal a first port to the tubing in a first condition and block the first port in a second condition. The passive access control mechanism including a movable piston, wherein in the first condition the piston is exposed to a first pressure source on a first side of the piston and to a second pressure source on a second side of the piston. The first pressure source is from within the tubing and the second pressure source is from outside of the chemical injection line and the tubing. Also included is a method of chemical injection in a downhole system.

18 Claims, 5 Drawing Sheets

DOWNHOLE SYSTEM HAVING CHEMICAL INJECTION VALVE ASSEMBLY AND METHOD OF CHEMICAL INJECTION

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. A completion system for producing natural resources from the borehole typically includes production tubing to deliver the natural resources from a reservoir to a surface location where the natural resources can then be harvested, collected, or processed. As natural resources flow through a perforation cavity or through a horizontal borehole, the pressure in the production tubing is less than the pressure in the formation. The greater the difference between the two pressures, the higher the flow rate. This differential pressure that drives the natural resources from the formation into the production tubing is called the drawdown pressure.

Chemical injection systems for injecting chemical fluids into the production tubing include a chemical injection line that extends to the surface where the borehole is drilled. Chemicals, such as demulsifiers, clarifiers, corrosion inhibitors, scale inhibitors, dewaxers, and surfactants can be pumped downhole into the production tubing via the chemical injection line for assisting in the production process. The chemical injection line can be connected to a chemical injection valve at the production tubing for controlling flow between the chemical injection line and the production tubing. Chemical injection valves include check valves to block unwanted fluids from entry therein by preventing fluid from the production tubing from entering the chemical injection lines. The chemical injection valve also includes a main spring which must be overcome by a certain opening pressure to prevent the chemical inside the chemical injection line from flowing freely into the production tubing or borehole until the pressure within the chemical injection line during chemical delivery is sufficient to open the valve. Current technology for chemical injection valves employ main springs capable of supporting up to 4,000 psi of hydrostatic pressure.

The art would be receptive to downhole systems having chemical injection valves capable of dealing with varying pressures, and methods for compensating for downhole pressures.

SUMMARY

A downhole system having a chemical injection valve assembly configured to inject at least one chemical from a chemical injection line into a downhole tubing, the chemical injection valve assembly includes a passive access control mechanism configured to reveal a first port to the tubing in a first condition and block the first port in a second condition, the passive access control mechanism including a movable piston, wherein in the first condition the piston is exposed to a first pressure source on a first side of the piston and to a second pressure source on a second side of the piston, the first pressure source from within the tubing and the second pressure source from outside of the chemical injection line and the tubing.

A method of chemical injection in a downhole system, the method includes injecting chemical via a chemical injection line and chemical injection valve assembly into a first port in a downhole tubing, in a first condition of a passive access control mechanism within the chemical injection valve assembly; and, blocking the first port in a second condition of the passive access control mechanism; wherein the passive access control mechanism is responsive to a pressure differential between pressure within the tubing and pressure outside of the tubing and the chemical injection line, and pressure within the tubing is greater in the first condition than in the second condition.

BRIEF DESCRIPTION OF THE DRAWINGS

Referring now to the drawings wherein like elements are numbered alike in the several Figures.

DETAILED DESCRIPTION

High pressure oil and gas wells are being tapped into in excess of 25,000 psi where maximum drawdown pressures may potentially reach 6,000 psi. This drastic change in pressure creates a large pressure differential between a chemical injection line pressure and production tubing pressure. When well conditions change, such as reducing pressures in the production tubing through hydrocarbon production, if the hydrostatic pressure inside the chemical injection line is greater than the production tubing pressure at a location of a chemical injection valve, the chemical injection valve must hold up the hydrostatic column of fluid uphole of the chemical injection valve or an unintended release of chemicals into the production tubing may occur. However, current technology is limited to 4,000 psi in which only spring force within the chemical injection valve is used to control the hydrostatic pressure above the chemical injection valve.

Figure 1:
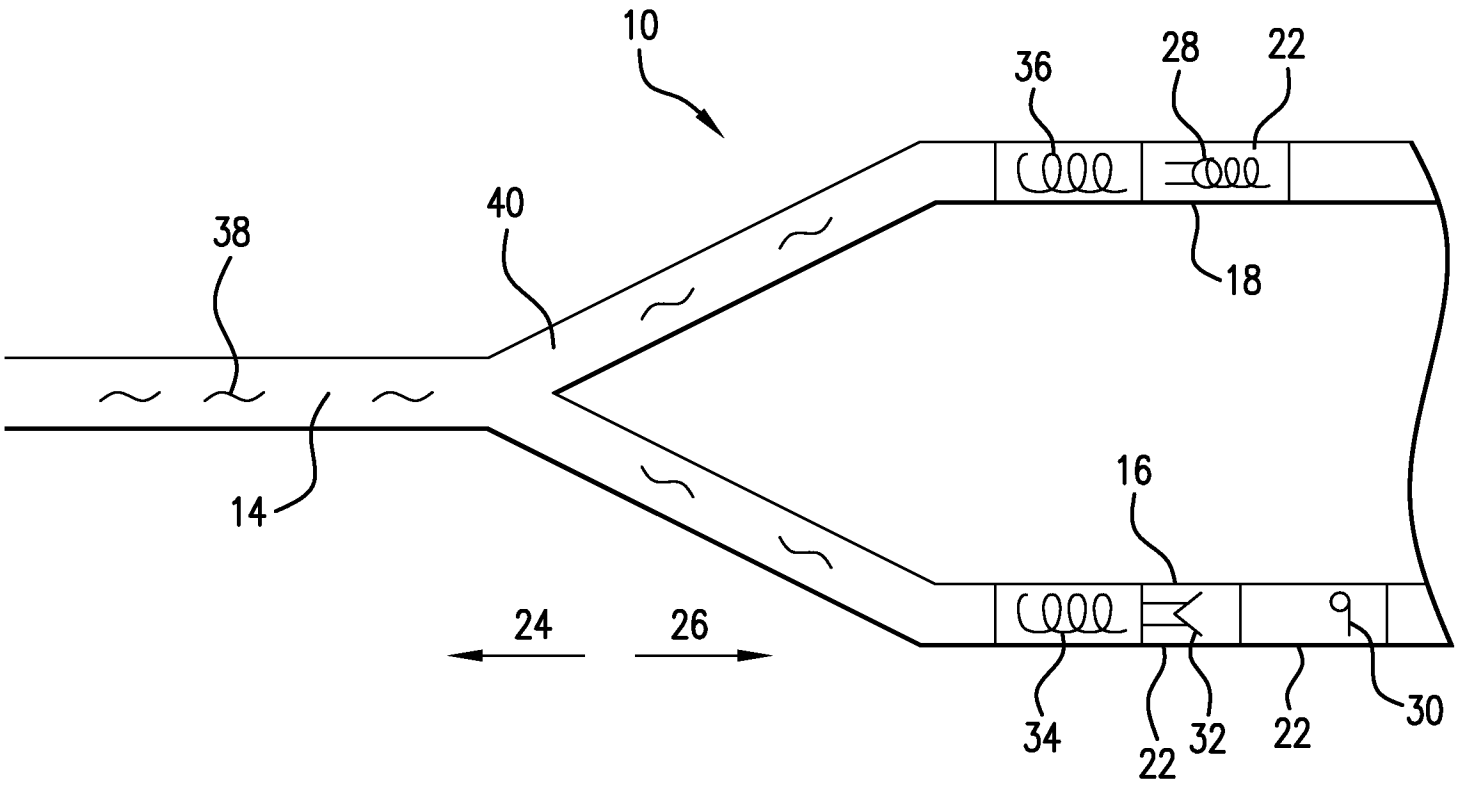
FIG. 1 shows a schematic view of an uphole portion of an exemplary embodiment of a chemical injection valve assembly.
Figure 2:
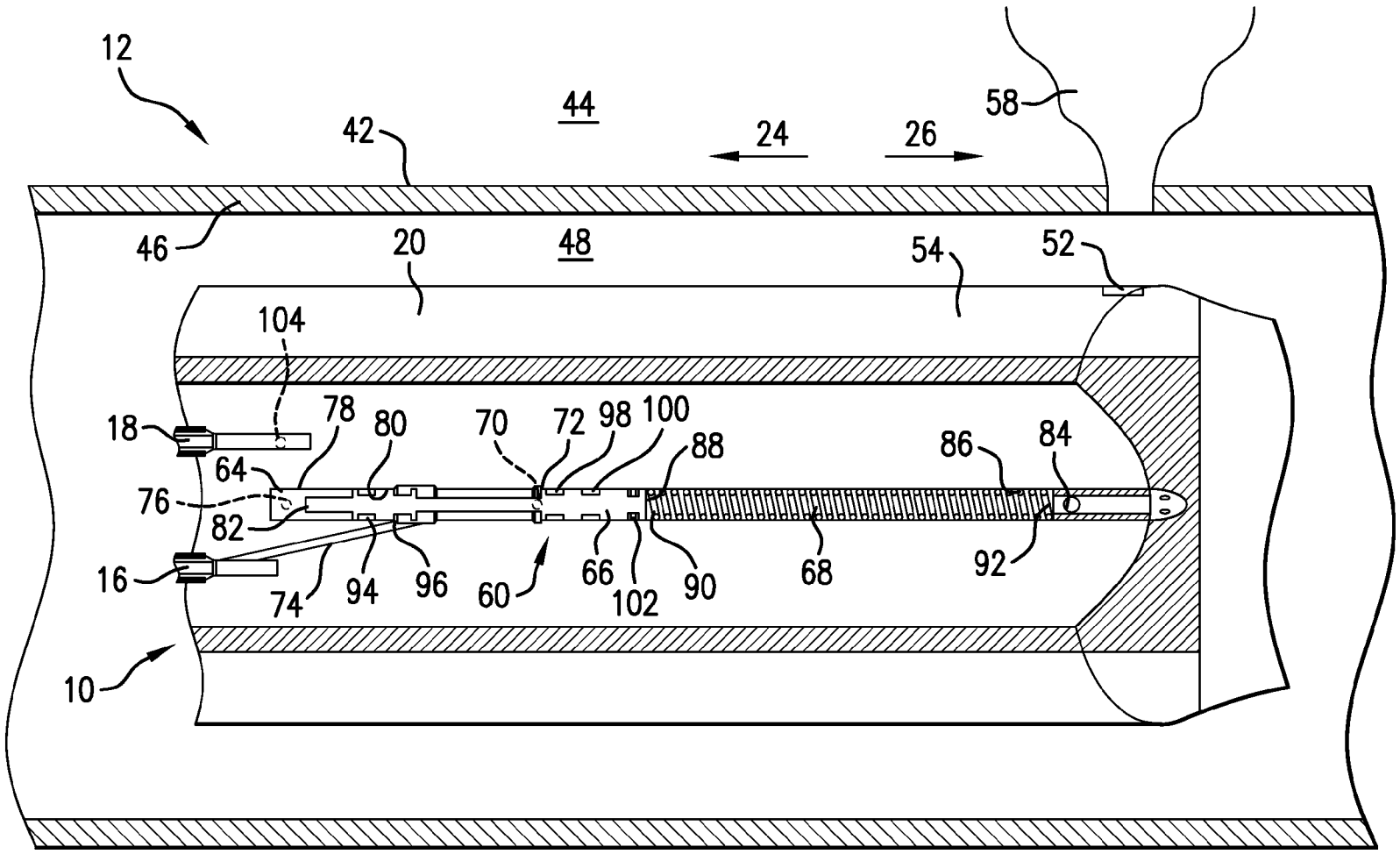
FIG. 2 shows a partial cross-sectional view of a downhole portion of the exemplary embodiment of the chemical injection valve assembly in an exemplary downhole system in a first condition of an exemplary embodiment of a passive access control mechanism.
Figure 3:
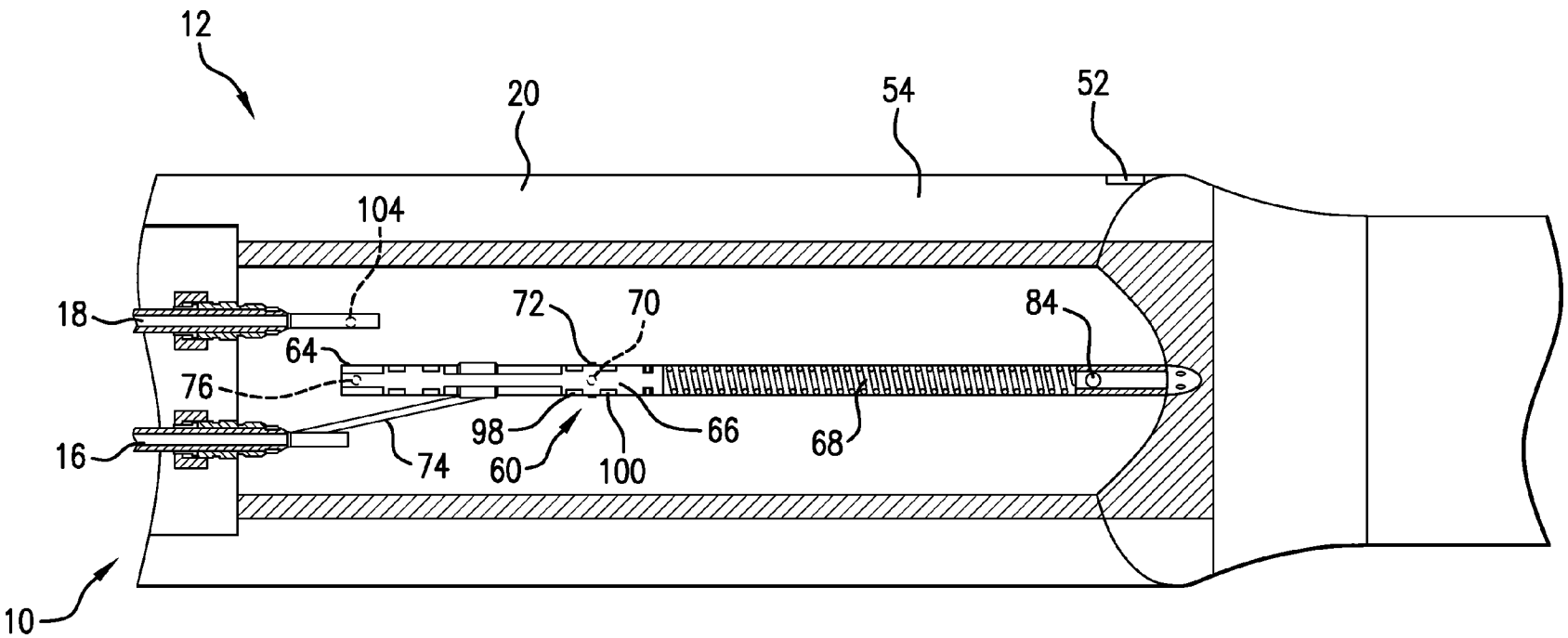
FIG. 3 shows a partial cross-sectional view of the downhole portion of the chemical injection valve assembly of FIG. 2 in a second condition of the passive access control mechanism.

An exemplary embodiment of a downhole pressure compensating chemical injection valve assembly 10 is shown in FIGS. 1-3. FIG. 1 shows an uphole portion of the valve assembly 10 and FIGS. 2-3 show a downhole portion of the valve assembly 10 within an exemplary downhole system 12. FIG. 1 depicts a section of the chemical injection line 14, and first and second chemical injection valves 16, 18. The chemical injection line 14 is extendable to an uphole location, such as a surface location or other remote location, having access to a supply of chemical(s) for injection. The chemical injection line 14 may be attached to an outer diameter of tubing (FIGS. 2-3) by tubing collar clamps and/or a chemical injection mandrel (not shown). Alternatively, the chemical injection line 14 may be partially or wholly incorporated within a passageway within a wall of the tubing 20 or provided on or within a separate tubular supporting structure positioned relative to the tubing 20. The first and second chemical injection valves 16, 18 each include at least one check valve 22. The check valve 22 is a one direction valve in that the flow there through is not permitted in an uphole direction 24, but can be overcome to allow flow in the downhole direction 26. The check valve 22 could be any one or a combination of a ball check valve 28, flapper valve 30, cone valve 32, or any other suitable valve for preventing fluids from the tubing 20 from entering the chemical injection line 14. The arrangement of a variety of check valves 22 depicted in FIG. 1 is for exemplary purposes only and alternate arrangements and number of check valves 22 would be selected based on the needs for a particular operation. The first and second chemical injection valves 16, 18 also each include a main spring 34, 36 for supporting the hydrostatic column of fluid/chemicals 38 contained within the chemical injection line 14. In this exemplary embodiment, the spring constant of the second spring 36 for the second chemical injection valve 18 is greater than the spring constant of the first spring 34 for the first chemical injection valve 16. Thus, greater pressure is required to overcome the second spring 36 than the first spring 34. The chemical injection line 14 deviates to the first and second chemical injection valves 16, 18 such as by a Y branch 40. Chemicals flowing in the downhole direction 26 will choose the path of least resistance, which in an initial condition will be the first chemical injection valve 16 due to the lower spring constant in the first spring 34 in the first chemical injection valve 16. While the check valves 22 and main springs 34, 36 are illustrated in FIG. 1 for clarity, it should be understood that these elements may be positioned closer to ports in the tubing 20, as will be further described below.

Figure 4:
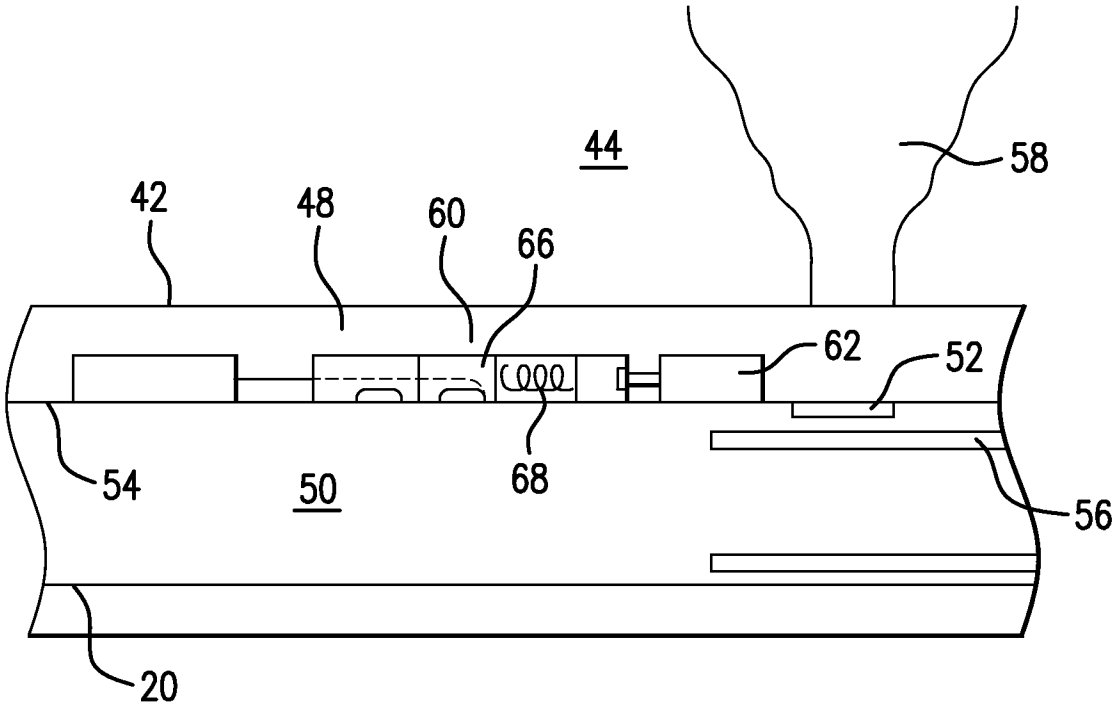
FIG. 4 shows a schematic view of an alternative exemplary embodiment of the chemical injection valve assembly in an exemplary downhole system; and, FIG. 5 shows a schematic view of another alternative exemplary embodiment of the chemical injection valve assembly.

FIGS. 2-3 depict the tubing 20, such as production tubing, upon which the chemical injection valve assembly 10 is integrated. The tubing 20 is disposed within a borehole 42 in a formation 44. Between the tubing 20 and the formation 44 there may be a casing 46, screen, other tubings, an annulus 48, etc. In any case, a flow path between the interior 50 (FIG. 4) of the tubing 20 and the formation 44 is formed, such as via a flow port 52 in the wall 54 of the tubing 20, and the interior 50 of the tubing 20 is exposed to the pressure in the formation 44. Access to the interior 50 of the tubing 20 may be permitted or restricted through the use of any type of flow control valve, dissolution of a dissolvable material within the flow port 52, movement of a sliding sleeve 56 (FIG. 4), or any combination of such elements. Flow of natural resources from the formation 44 to the production tubing 20 may be enhanced by a fracturing operation to form a fracture 58 in the formation 44.

The valve assembly 10 includes a passive access control mechanism 60, shown in FIGS. 2 and 3, that is activated by the differential pressure between first and second pressure sources. The first pressure source is the pressure in the tubing 20 and the second pressure source may be the pressure in the annulus 48 surrounding the tubing 20. Alternatively, in lieu of annulus pressure, the passive access control mechanism 60 could be tied to an enclosed pressure source 62, such as a nitrogen chamber or an atmospheric chamber, demonstrated in FIG. 4. The passive access control mechanism 60 includes a housing 64, a piston 66 longitudinally movable within the housing 64, and a biasing device such as spring 68 biasing the piston 66 in an initial condition to reveal a first port 70 in the tubing 20, as shown in FIG. 2. The first port 70 may be located at groove 72 of the housing 64. The first chemical injection valve 16 is fluidically connected to the first port 70, such as via first connection line 74, in the initial condition of the piston 66. The housing 64 includes a first inlet 76 exposing a first side 78 of an interior 80 of the housing 64, on a first side 82 of the piston 66, to pressure within the tubing 20. The housing 64 further includes a second inlet 84 exposing a second side 86 of the interior 80 of the housing 64, on a second side 88 of the piston 66, to pressure within the annulus 48 or pressure chamber 62. The spring 68 includes a first side 90 at the second side 88 of the piston 66 and movable with the piston 66, and a second side 92 rigidly fixed at the housing 64. First and second seals 94, 96 are provided along the piston 66, as are third and fourth seals 98, 100. The first, second, third, and fourth seals 94, 96, 98, 100 are movable with the piston 66. Also supported by the piston 66 may be a snap ring 102 which is located in the initial condition between the fourth seal 100 and the second side 88 of the piston 66. While a snap ring 102 is shown, alternate or additional initial condition restraining devices may be used such as shear members.

In an initial condition shown in FIG. 2, the piston 66 is exposed on the first side 82 of the piston 66 to pressure from the first inlet 76 and exposed on the second side 86 of the piston 66 to pressure from the second inlet 84. Due to higher production pressure early in the life of the downhole system 12, the pressure entering the first inlet 76 will be greater than the pressure entering the second inlet 84, and thus the piston 66 will be pushed against the spring 68, such as in the downhole direction 26 if the first inlet 76 is uphole of the second inlet 84, and the first port 70 into the tubing 20 will be exposed to allow flow between the first port 70 and the first chemical injection valve 16. When one or more chemicals 38 are introduced into the chemical injection line 14, the chemicals 38 will pass through the first chemical injection valve 16 and into the tubing 20 via the first port 70.

During late well life, the pressure within the tubing 20 will drop such that the pressure in the chemical injection line 14 may be greater than that in the tubing 20. In the absence of the passive access control mechanism 60, and due to the limitations of the first main spring 34 in the first chemical injection valve 16 to support the hydrostatic column of chemicals 38 within the chemical injection line 14, whatever chemical(s) 38 are contained within the chemical injection line 14 may continue to be injected into the tubing 20 due to the differential pressure between the chemical injection line 14 and the tubing 20. However, due to the decreasing pressure through the first inlet 76, the spring 68 will bias the piston 66 within the passive access control mechanism 60 in a first direction, such as the uphole direction 24. The spring will move the first, second, third, and fourth seals 94, 96, 98, 100 and the snap ring 102 from the position shown in FIG. 2 to that shown in FIG. 3. With the first port 70 sealed from the first connection line 74, chemical injection into the tubing 20 through the first port 70 via the first chemical injection valve 16 is prevented. Thus even if the first spring 34 in the first chemical injection valve 16 is overcome, chemical(s) 38 cannot flow into the first port 70. Movement of the piston 66 to block the first port 70 may be achieved by alternative arrangements, such as by moving a wall of the piston 66 or other element supported by the piston 66 to separate the first port 70 from the first connection line 74. Thus, in this exemplary embodiment, the passive access control mechanism 60 serves as a closing device by closing the first port 70. At this point, if chemical injection is desired, the pressure within the chemical injection line 14 can be increased, such as by a chemical injection pump uphole of the chemical injection line 14, to overcome the second spring 36 in the second chemical injection valve 18 and chemical injection can be accomplished through the second port 104, which may be arranged to provide chemical injection into the tubing 20. While the passive access control mechanism 60 has been described as enabling diverting of flow from the first port 70 to the second port 104, depending on the needs of the downhole system 12, alternatively the second chemical injection valve 18 and the second port 104 need not be included and the first port 70 may simply be closed.

Figure 5:
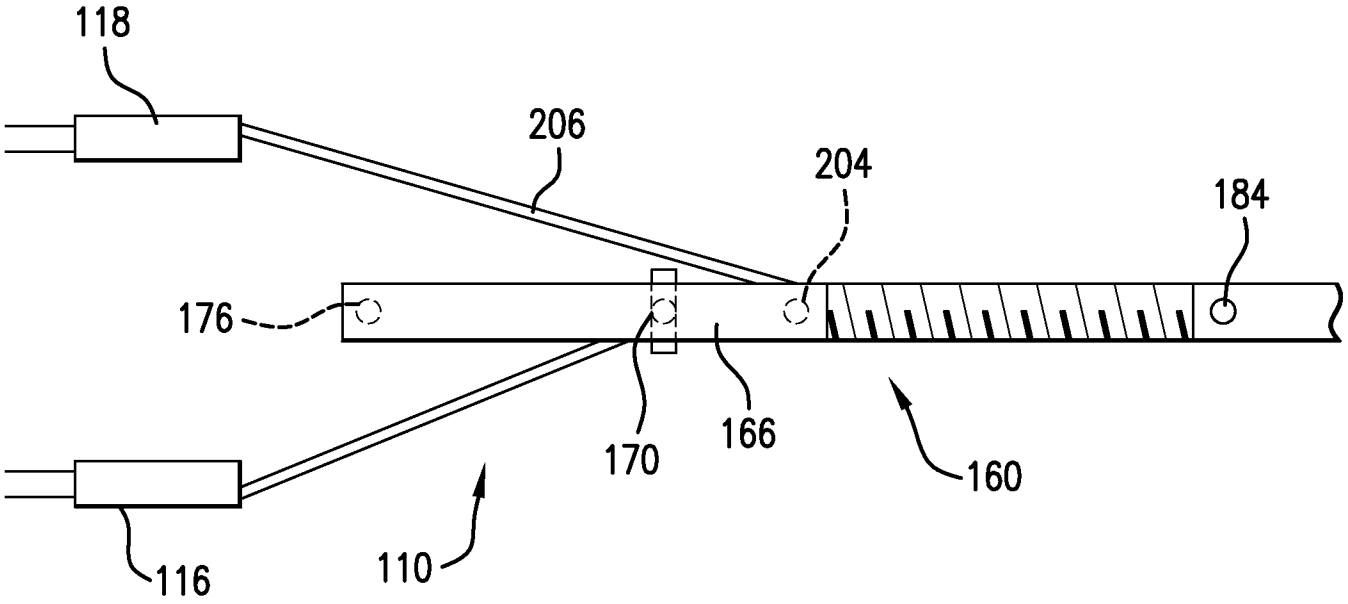

In another exemplary embodiment of a chemical injection valve assembly 110, schematically depicted in FIG. 5, a passive access control mechanism 160 includes a piston 166 movable initially to allow access through a first port 170 and subsequently close the first port 170 as previously described with respect to the passive access control mechanism 60 described in FIGS. 1-4. However, the passive access control mechanism 160 of FIG. 5 additionally includes a second port 204 in the tubing 20 exposed or revealed by piston 166 and passive access control mechanism 160. The second port 204 is fluidically connected to the second chemical injection valve 118, such as via second line 206. The piston 166 is arranged to restrict access to the second port 204 in an initial condition, when the pressure in the tubing 20 (FIGS. 2-4) passing through first inlet 176 is greater than the pressure through the second inlet 184, but also opens the second port 204 during the later stages, such as when the first port 170 is closed. In such an embodiment, first and second springs of the first and second chemical injection valves 116, 118 may have a substantially same spring constant. Thus, in this exemplary embodiment, the passive access control mechanism 160 serves as a switching device.

As a passively adjusting chemical injection valve assembly 10, 110, no well intervention will be required when well conditions change such as reducing pressures through hydrocarbon production. This passive feature thus possesses the potential to support very large pressure differentials anticipated in deepwater wells.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A downhole system having a chemical injection valve assembly configured to inject at least one chemical from a chemical injection line into a downhole tubing, the chemical injection valve assembly comprising:

a passive access control mechanism configured to reveal a first port to the tubing in a first condition and block the first port in a second condition, the passive access control mechanism including a housing, a movable piston movably supported within the housing, and a spring supported within the housing and biasing the piston to block the first port in the second condition, wherein in the first condition the piston is exposed to a first pressure source on a first side of the piston and to a second pressure source on a second side of the piston, the first pressure source from within the tubing and the second pressure source from outside of the chemical injection line and the tubing, an interior of the housing in communication with a first inlet exposed to the first pressure source, and a second inlet in the housing exposed to the second pressure source.

2. The downhole system of claim 1, wherein the second pressure source is annulus pressure between the downhole tubing and a formation.

3. The downhole system of claim 1, further comprising a nitrogen chamber, wherein the second pressure source is pressure from the nitrogen chamber.

4. The downhole system of claim 1, further comprising an atmospheric chamber, wherein the second pressure source is pressure from the atmospheric chamber.

5. The downhole system of claim 1, wherein the passive access control mechanism further includes a snap ring positioned in an initial position and configured to at least partially restrain the piston in the first condition, and the snap ring is movable from the initial position in the second condition.

6. The downhole system of claim 1, further comprising a first chemical injection valve fluidically connected to the first port in the first condition and blocked from the first port in the second condition.

7. The downhole system of claim 6, further comprising a second chemical injection valve fluidically connected to a second port into the tubing, the first and second chemical injection valves connected to the chemical injection line.

8. The downhole system of claim 7, further comprising the chemical injection line, wherein the chemical injection line includes a Y junction arranged to divert chemical to the second chemical injection valve when the first port is closed.

9. The downhole system of claim 7, wherein movement of the piston reveals the second port in the second condition.

10. A method of chemical injection in the downhole system of claim 1, the method comprising:

injecting chemical via the chemical injection line and the chemical injection valve assembly into the first port in the downhole tubing, in the first condition of the passive access control mechanism within the chemical injection valve assembly; and, blocking the first port in the second condition of the passive access control mechanism;

wherein the passive access control mechanism is responsive to a pressure differential between pressure within the tubing and pressure outside of the tubing and the chemical injection line, and pressure within the tubing is greater in the first condition than in the second condition.

11. The downhole system of claim 1, wherein, in the first condition, the piston is exposed to a differential pressure between the first pressure source from within the downhole tubing and the second pressure source from outside of the chemical injection line and the downhole tubing, and, in the second condition, a change in the differential pressure between the first and second pressure sources moves the piston to block the first port.

12. A downhole system having a chemical injection valve assembly configured to inject at least one chemical from a chemical injection line into a downhole tubing, the chemical injection valve assembly comprising:

a passive access control mechanism configured to reveal a first port to the tubing in a first condition and block the first port in a second condition, the passive access control mechanism including a movable piston, wherein in the first condition the piston is exposed to a first pressure source on a first side of the piston and to a second pressure source on a second side of the piston, the first pressure source from within the tubing and the second pressure source from outside of the chemical injection line and the tubing;

a first chemical injection valve fluidically connected to the first port in the first condition and blocked from the first port in the second condition; and, a second chemical injection valve fluidically connected to a second port into the tubing, the first and second chemical injection valves connected to the chemical injection line;

wherein the first and second chemical injection valves include first and second springs, respectively, and a spring constant of the first spring is less than a spring constant of the second spring.

13. A method of chemical injection in a downhole system, the method comprising:

injecting chemical via a chemical injection line and chemical injection valve assembly into a first port in a downhole tubing, in a first condition of a passive access control mechanism within the chemical injection valve assembly, the chemical injection valve assembly including a first chemical injection valve having a first spring and a second chemical injection valve having a second spring; and, blocking the first port in a second condition of the passive access control mechanism;

subsequent blocking the first port, diverting chemical through the chemical injection line to a second port by overcoming the second spring in the second chemical injection valve with an injection pressure greater than an injection pressure required to overcome the first spring;

wherein the passive access control mechanism is responsive to a pressure differential between pressure within the tubing and pressure outside of the tubing and the chemical injection line, and pressure within the tubing is greater in the first condition than in the second condition.

14. The method of claim 13, wherein the pressure outside of the tubing and chemical injection line is one of annulus pressure, nitrogen pressure and atmospheric pressure.

15. The method of claim 13, wherein blocking the first port includes passively moving a piston in the passive access control mechanism in response to a decrease in the pressure within the tubing.

16. The method of claim 13, wherein the second port is blocked in the first condition, and further comprising passively moving a piston in the passive access control mechanism to reveal the second port in the second condition.

17. The method of claim 13, wherein blocking the first port includes moving a piston in an area of the first port.

18. The method of claim 13, further comprising biasing a piston within the passive control mechanism into the second condition.

* * * * *